United States Patent [19]

Koyanagi

[11] Patent Number: 4,644,475

[45] Date of Patent: Feb. 17, 1987

[54] METHOD OF CONTROLLING ACTUATOR BY APPLYING DRIVING PULSE

[75] Inventor: Yuzo Koyanagi, Warabi, Japan

[73] Assignee: Sanwa Seiki Mfg. Co., Ltd., Yono, Japan

[21] Appl. No.: 688,871

[22] Filed: Jan. 4, 1985

Related U.S. Application Data

[63] Continuation-in-part of Ser. No. 317,603, Nov. 3, 1981, abandoned.

[51] Int. Cl.[4] ..... F02D 35/00; F02D 41/02; F02D 41/26

[52] U.S. Cl. ..... 364/431.07; 123/339; 123/493; 364/431.05

[58] Field of Search ..... 364/431.03; 123/486, 123/501, 502; 73/119 A

[56] References Cited

U.S. PATENT DOCUMENTS

| | | | |
|---|---|---|---|
| 3,796,197 | 3/1974 | Locher et al. | 123/501 X |
| 4,143,632 | 3/1979 | Kobayashi | 123/502 |
| 4,217,862 | 8/1980 | Fort et al. | 123/501 X |
| 4,265,200 | 5/1981 | Wessel et al. | 123/501 |
| 4,305,366 | 12/1981 | Imasato et al. | 123/502 |
| 4,355,621 | 10/1982 | Yasuhara | 123/502 |
| 4,359,032 | 11/1982 | Dhie | 123/486 X |
| 4,455,867 | 6/1984 | Koyanagi | 73/119 A |

FOREIGN PATENT DOCUMENTS

| | | | |
|---|---|---|---|
| 56-54959 | 5/1981 | Japan | 123/502 |
| 56-75961 | 6/1981 | Japan | 123/501 |
| 2090676 | 7/1982 | United Kingdom | 123/502 |

OTHER PUBLICATIONS

Elgerd: Control Systems Theory (Textbook) McGraw-Hill Ltd. (Tokyo) 1967 Chapter 8: Nonlinear Control Systems, pp. 263–266 of Interest.

*Primary Examiner*—Felix D. Gruber
*Attorney, Agent, or Firm*—Henry Sternberg; Bert J. Lewen

[57] ABSTRACT

A controlling method for pulse application to an actuator using a digital controller.

A controlling method of an actuator, wherein a deviation is obtained from a command value and its feedback value, the absolute value of said deviation is determined whether it is larger than the minimum reference deviation corresponding to the dead zone, and only when the absolute value of the deviation is larger than the minimum reference deviation, the actuator is driven by a pulse having an application period proportional to the absolute value of the deviation plus a minimum application period stored in the memory of the digital controller.

The minimum application period stored in the memory is increased or decreased and renewed depending on the judgement whether the movement volume of the actuator at each pulse application was under, proper or over.

13 Claims, 8 Drawing Figures

METHOD OF CONTROLLING ACTUATOR BY APPLYING DRIVING PULSE

This application is a Continuation-in-Part of application Ser. No. 317,603 filed Nov. 3, 1981 and now abandoned.

BACKGROUND OF THE INVENTION

This invention relates to a method of controlling an actuator by applying a driving pulse, more particularly to a method of controlling a hydraulic actuator including a solenoid valve by applying a driving pulse.

As a low cost and simple method of controlling an actuator, a method which is called "on-off control" or "bang-bang control", as shown in a 1967 publication entitled. "Control Systems Theory" by Oile I. Elgerd, published by McGraw-Hill has been conventionally known. In a case of controlling a hydraulic actuator consisting of an electromagnetic valve and a cylinder in applying the bang-bang control having an appropriate dead zone relating to the deviation between the command value and its feedback value, once a deviation between the command value and its feedback value in the control system exceeds said predetermined dead zone, the controller will immediately apply voltage to a coil of the elecromagnetic valve which will operate to reduce the deviation. Then, when the actuator is so displaced that the deviation comes within a given dead zone, the controller immediately stops application of voltage to the electromagnetic valve. However, in spite of such immediate stop of the voltage application to the electromagnetic valve, the actuator cannot stop immediately due to the inductance of the electromagnetic valve coil and the inertia of the actuator and overruns. The magnitude of this overrun depends on the operating speed of the actuator as well as said inductance and the response speed of the electromagnetic valve. Namely, the faster the operating speed of the actuator, the greater the magnitude of the overrun. When the overrun exceeds the dead zone, the controller will drive the electromagnetic valve in opposite direction to the previous operation. Consequently, the so-called limit cycle oscillation will occur unless the dead zone for the deviation was set in response to the maximum operating speed of the actuator. For this reason, with the bang-bang control, the dead zone should be enlarged in order to obtain a better responsiveness of the system by making the operating speed of the actuator faster and this means that the precision in positioning of the actuator is decreased.

As a control method having better performance in both responsiveness and precise positioning than the bang-bang control, a new servo system to operate an actuator was developed by way of converting the deviation between a command value and its feedback value into a pulse width of a digital pulse train in pulse-width-modulation, and said pulse train driving a proportional control valve in place of an on-off electromagnetic valve. The pulse train having variable duty ratios is changed through a coil of the proportional control valve into the equal analog voltage to act on the coil. This servo system enables a high speed response and a high precision, but on the other hand an expensive proportional control valve is indispensible, discouraging its use for motor vehicle control system.

SUMMARY OF INVENTION

An object of the present invention is to provide a method of controlling an actuator which allows both high speed response and high precision without the sacrifice of precision in obtaining high speed response as in the case of bang-bang control.

Another object of the invention is to provide a method of controlling an actuator, without using such an expensive control element as a proportional control valve, particularly suitable for a control system for motor vehicles which calls for low cost.

A further object of this invention is to provide a method of controlling an injection timing regulator of a fuel injection pump for an internal combustion engine.

The injection timing regulator is already known publicly, such as the one shown in U.S. Pat. No. 4,305,366, in which a slider having a straight spline inside and a helical spline outside is provided between the input shaft and the output shaft and is hydraulicaly operated to control the relative rotational phase angle between the input and output shafts.

In the method of controlling an actuator according to the present invention, a digital controller decides a pulse duration to be applied to the actuator. The pulse application is not continued until the controller detects entry of the deviation into the predetermined dead zone as in the case of bang-bang control, but is made only during the period predetermined by the digital controller. The pulse application period is the minimum application period enabling the actuator to start operation as determined by the responsiveness of the actuator plus the application period proportional to the absolute value of the deviation between a command value and its feedback value. The application period, proportional to the absolute value of the deviation, is computed using a coefficient determined by the direction of the operation of the actuator. When the absolute value of the deviation is larger than the predetermined maximum reference deviation, the one applied to the actuator is not the pulse having the application period computed as above explained, but an unbroken voltage continuously applied until the absolute value of the deviation becomes smaller than the maximum reference deviation.

The initial value of minimum application period predetermined by experiments is stored in the memory of the digital controller and this initial value is used only at the first application to the actuator, the actuator movement volume is evaluated by the digital controller and at each under application or over application, the minimum application period is increased or decreased and the value stored in the memory is changed.

DESCRIPTION OF THE PREFERRED EMBODIMENT

Figure 1:
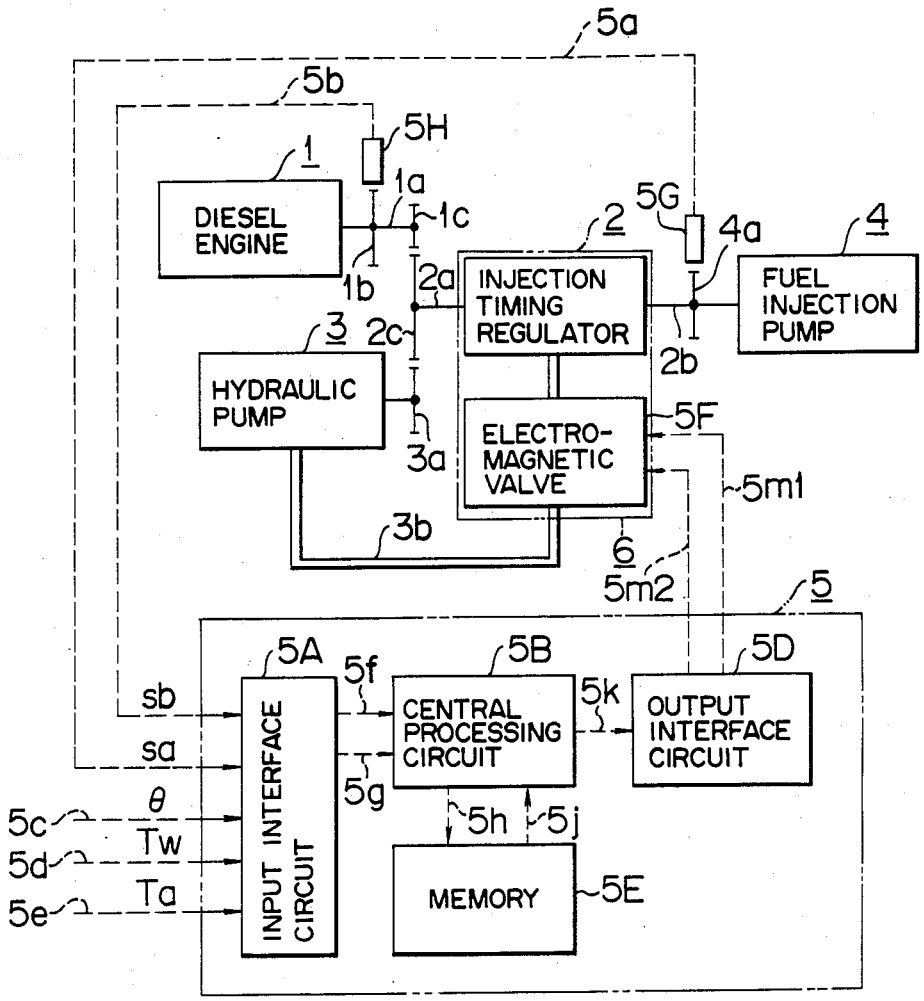
FIG. 1 is a system diagram of the control method according to the present invention used for a fuel injection timing regulator for a diesel engine.

Referring now in detail to the drawings, FIG. 1 is a system diagram of the control method according to the present invention when it is used for a fuel injection timing regulator for a diesel engine.

A diesel engine 1 is connected with a fuel injection timing regulator 2 (which is a portion of an actuator 6) through gears 1*c* and 2*c*. An output shaft 2*b* of the fuel injection timing regulator 2 varies the relative rotational phase angle between the input shaft 2*a* and the output shaft 2*b*, in response to the speed, load, etc. of the diesel engine 1, so as to properly adjust the injection timing of the fuel injection pump 4.

The fuel injection pump 4 is a well known one of the piston type for the diesel engine and has the same number of pistons and cylinders as that of the cylinders of the diesel engine 1. Respective pistons in the cylinders are operated by a pump camshaft connected with the input shaft and fuel is injected into respective cylinders of the diesel engine corresponding to said respective pistons, in the vicinity of the top dead center of respective cylinders of the diesel engine 1.

If the relative rotational phase angle between the input shaft 2*a* and the output shaft 2*b* of the injection timing regulator 2 is varied, the relative rotational phase angle between the crankshaft 1*a* of the diesel engine 1 and the pump camshaft of the fuel injection pump 4, which are mechanically connected with the injection timing regulator 2, is also varied and accordingly the injection timing to the top dead center of respective cylinders of the diesel engine 1 is varied.

The hydraulic pump 3 is driven by the diesel engine 1 through a gear, serving as a hydraulic power source for the electromagnetic valve 5F which is a portion of the actuator 6.

The crankshaft 1*a* of the diesel engine 1 has a disk 1*b* which is used to detect the rotational phase angle and the engine speed, and the output shaft 2*b* also has a similar disk 4*a*. The disks 1*b* and 4*a* have the circumference provided with a train of bosses disposed at a constant interval. Confronting the circumference of the disks 1*b* and 4*a*, there are fixedly provided electromagnetic pickups 5H and 5G in the neighborhood of the disks 1*b* and 4*a* for detecting the positions of said bosses.

Signals sa and sb from the electromagnetic pickups 5G and 5H are fed into a microcomputer 5. Further signal lines 5*c*, 5*d* and 5*e* are provided for respectively transmitting into the microcomputer 5 displacement of accelerator pedal for the operation of the diesel engine 1, the water temperature in the water jacket Tw and the air temperature Ta.

The microcomputer 5 consists of an input interface circuit 5A, central processing circuit 5B, a memory 5E and an output interface circuit 5D.

The output from the microcomputer 5 is fed to the electromagnetic valve 5F through one of either lines 5*m*1 or 5*m*2 to drive one of the solenoid coils of the electromagnetic valve 5F by an on-off type electric pulse signal.

The electromagnetic valve 5F is, for example, a 3-position 4-way directional flow control valve having two solenoid coils. When both of the solenoid coils are not energized, the electromagnetic valve 5F is at the neutral position and the hydraulic line between the electromagnetic valve 5F and the injection timing regulator 2 is closed so that the injection timing regulator 2 may be kept as it stands.

When one of the solenoids is energized through the line 5*m*1, the electromagnetic valve 5F is changed over to one direction and the oil from the hydraulic pump 3 is so supplied to the injection timing regulator 2 as to operate it to advance the injection timing of the fuel injection pump 4. Also, when another solenoid is energized through the line 5*m*2, the electromagnetic valve 5F is changed over to the other direction and the oil from the hydraulic pump 3 is so supplied to the injection timing regulator 2 as to operate it to retard the injection timing of the fuel injection pump 4.

Figure 2:
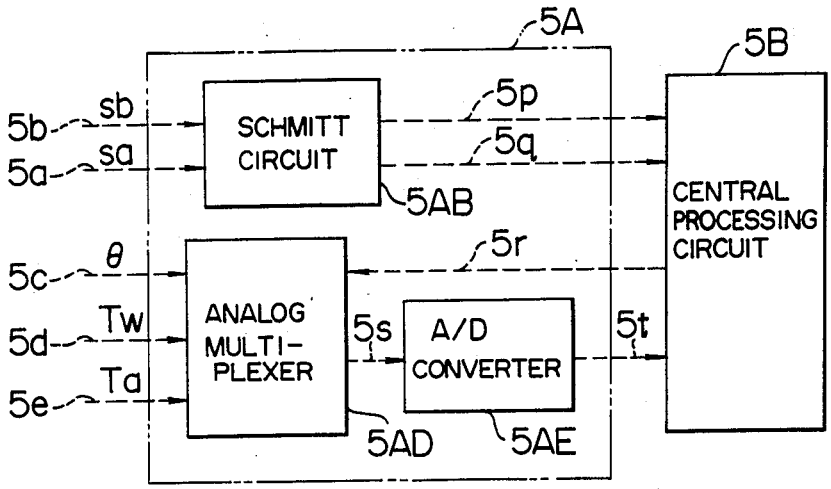
FIG. 2 is a block diagram of an input interface circuit shown in FIG. 1.
Figure 3:
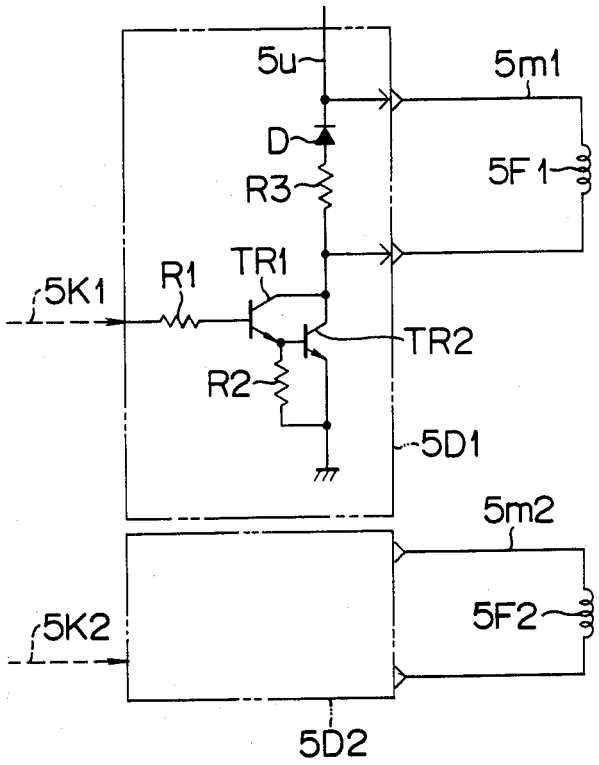
FIG. 3 is a circuit diagram of an output interface circuit shown in FIG. 1.

Details of the input interface circuit 5A and the output interface circuit 5D of the microcomputer 5 are shown respectively in FIGS. 2 and 3.

The input interface circuit 5A consists of a Schmitt circuit 5AB which shapes signals sa and sb from the electromagnetic pickups 5G and 5H, an analog muliplexer 5AD which selects one of those analog signals of the displacement of the accelerator pedal $\theta$, water temperature Tw and air temperature Ta, and an A/D converter 5AE which transforms the thus selected analog signals into the digital signals.

Figure 7:
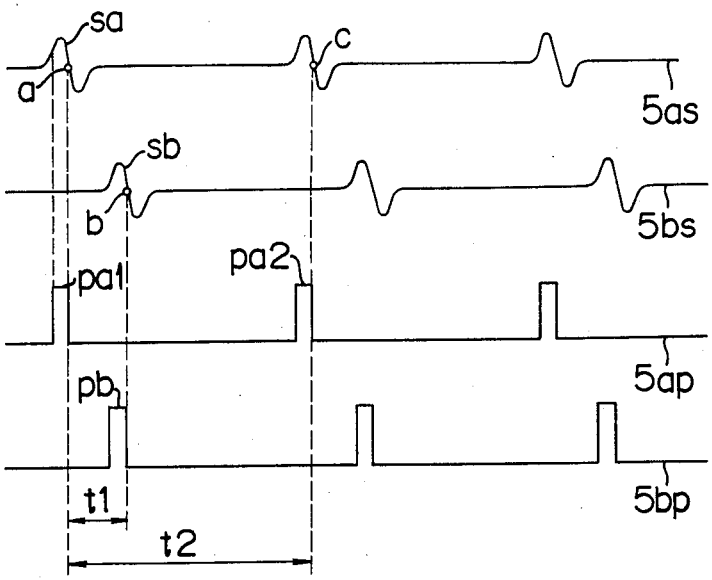
FIG. 7 is a chart of waveforms from two electromagnetic pickups shown in FIG. 1 and the pulse waveforms after each of the above mentioned waveforms was transformed by the Schmitt circuit shown in FIG. 2.

The signals transformed by the Schmitt circuit 5AB are fed into a central processing circuit 5B in the form of pulse signals like 5*ap* and 5*bp* in FIG. 7.

The output interface circuit shown in FIG. 3 is a circuit which drives two solenoid coils 5F1 and 5F2 of the electromagnetic valve 5F of FIG. 1. Since another circuit 5D2 is the same as the circuit 5D1, the inside detail of 5D2 is omitted. On-off pulses sent over from the central processing circuit 5B through a line 5K1 or 5K2 turn on or off transistors of Darlington connection in one of either circuit 5D1 or 5D2, to energize the solenoid coil 5F1 or 5F2, connected respectively thereto, of the electromagnetic valve 5F.

Figure 4:
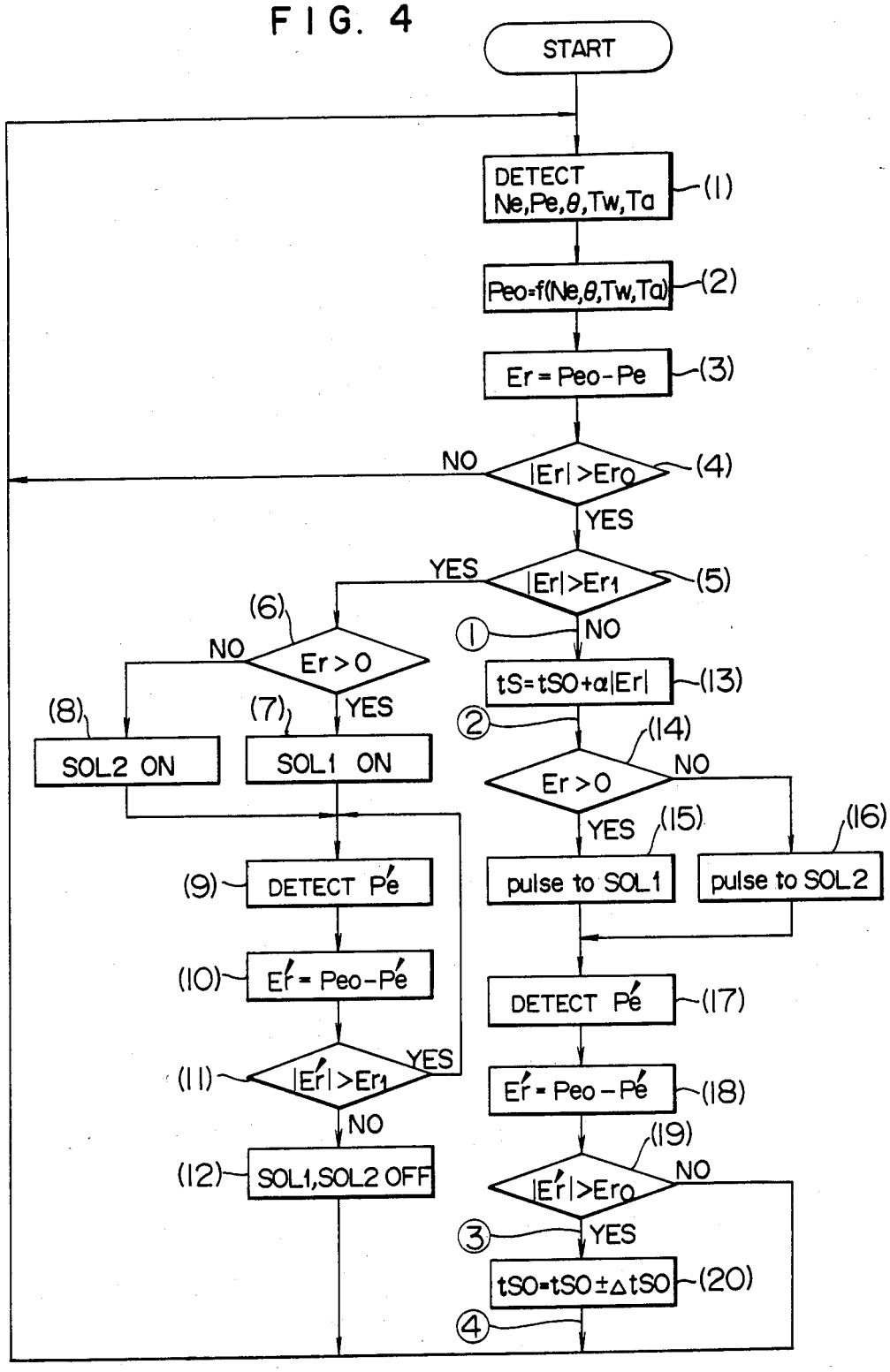
FIG. 4 is a flow sheet of the control method according to the present invention when it is used for the control system as shown in FIG. 1.
Figure 5:
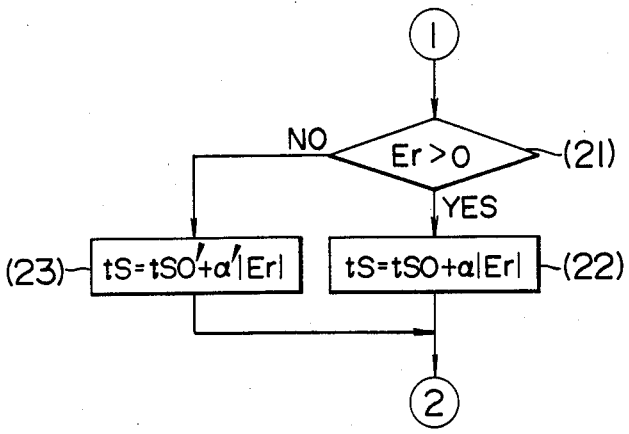
FIG. 5 is a detail flow sheet covering (1) and (2) in FIG. 4.
Figure 6:
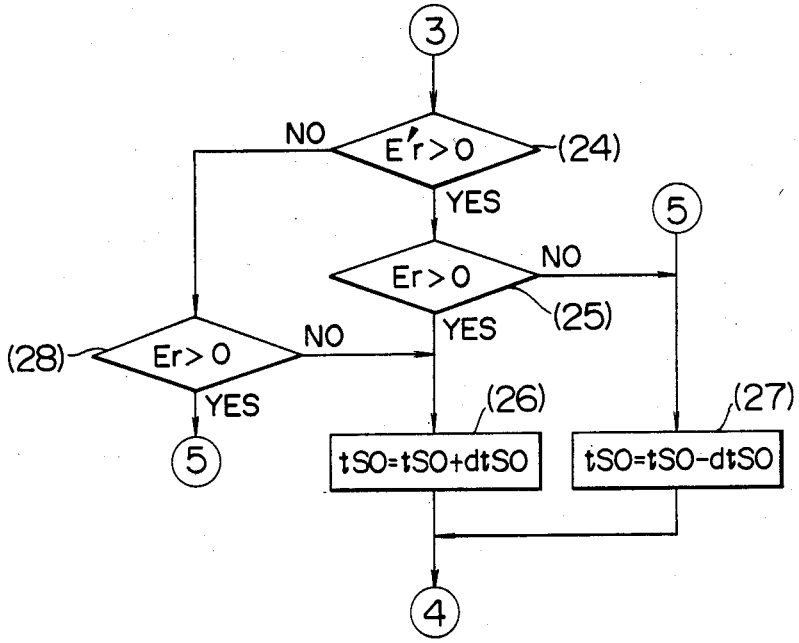
FIG. 6 is a detail flow sheet covering (3) and (4) in FIG. 4.

FIG. 4 is a flow sheet showing the control method for the control system shown in FIGS. 1, 2 and 3 to which the control method according to the present invention is applied. FIGS. 5 and 6 are the detail flow sheet of parts of FIG. 4. Now referring to FIGS. 4, 5 and 6, the control method according to the present invention is described in detail. The control starts by turning on the microcomputer 5.

STEP (1):

At the beginning of the control cycle, in order to know the operating conditions of the diesel engine 1 and its surrounding condition, the engine speed Ne, actual timing of fuel injection Pe, displacement of accelerator pedal $\theta$, water temperature Tw and air temperature Ta, are detected.

Signals representing the displacement of accelerator pedal $\theta$, water temperature Tw and air temperature Ta are selected one after another, converted to digital signals and stored in the memory 5E. The engine speed Ne and the fuel injection timing Pe are not measured directly but computed by the microcomputer 5 from the signals from the electromagnetic pickups 5G and 5H.

Now referring to FIG. 7, there is described how to detect the engine speed Ne and the fuel injection timing Pe. When a train of bosses disposed on the circumference of the disks 1*b* and 4*a* which are combined respectively with the crankshaft 1*a* and the output shaft 2*b* of the injection timing regulator 2 pass over each of the electromagnetic pickups 5H and 5G fixedly provided in the neighborhood of these disks, the electromagnetic pickups 5H and 5G generate voltages of such wave form shown as sa and sb in FIG. 7. The voltage waveforms sa and sb are shaped by the Schmitt circuit 5AB into such rectangular form pulse signals as pa1 and pb in FIG. 7 and fed into the central processing circuit 5B. The abscissa in FIG. 7 represents time and each pulse appears successively at equal intervals if the engine speed is constant.

The central processing circuit 5B measures the time t1 and t2 between the pulse signals pa1 and pb and between those pa1 and pa2 in FIG. 7 by the use of a built in timer. Further, the central processing circuit 5B computes the engine speed Ne and the fuel injection timing Pe as follows using the above measured time t1 and t2:

$$Pe=(c1\times t1)/t2 \quad (1)$$

$$Ne=c2/t2 \quad (2)$$

where c1 and c2 are the constants determined from the number of bosses disposed on the circumference of the disks 1*b* and 4*a* or the geometric angle between the two neighboring bosses. The above formula (1) gives the fuel injection timing Pe when the relative fitting locations of each boss of the disk 4*a* and the corresponding electromagnetic pickup 5H are so arranged that the point b the signal sb in FIG. 7 may be the top dead center of a predetermined cylinder of the diesel engine 1.

STEP (2):

The computer 5 computes a command value Peo for the fuel injection timing from those values fo Ne, Pe, $\theta$, Tw and Ta obtained from the above step. In the memory 5E of the computer 5 are stored best timing data for the fuel injection timing, concerning water temperature, air temperature accelator pedal displacement and engine speed which are obtained beforehand by experiments for the engine as the object for this control. By dividing, for example, the displacement of accelerator pedal and the engine speed respectively into several parts, and for each part thus divided, the optimum injection timing is obtained experimentally and stored in the memory. Different data are stored for each predetermined range of water and air temperature. For the area between one part of the division and the next, the central processing circuit 5B generates the command value by proportional complemental computation.

STEP (3):

This step determines a deviation Er between the command value Peo of the fuel injection timing and the already obtained actual timing Pe of fuel injection as the feedback value.

STEP (4):

By this step, it is determined whether the absolute value of the deviation Er is larger than the minimum reference deviation Ero predetermined and stored beforehand in the memory 5E. When the absolute value of the deviation Er is determined not larger thanthe minimum reference deviation Ero, the computer 5 does not send a driving signal to the electromagnetic valve 5F of actuator 6 but the control step goes back to the 1st step of the control cycle, repeating Steps (1) to (4).

STEP (5):

When it is determined that the absolute value of the deviation Er is larger than the minimum reference deviation Ero, it is determined by this step whether the absolute value of the deviation Er is larger than the maximum reference deviation Er predetermined and stored in the memory. As shown in FIG. 4, depending on the determination obtained at this step, the control system is divided into two ways. Now is described the first case where the absolute value of the deviation Er is determined larger than the maximum reference deviation Er1.

STEP (6):

When it is determined that the absolute value of the deviation Er is larger than the maximum reference deviation Er1, determine the sign of the deviation Er.

STEP (7):

When the sign of the deviation Er is determined positive, that is, that the command value Peo is larger than the feedback value Pe, the central processing circuit 5B sends a signal to the output interface circuit 5D so as to turn on one Darlington transistor, energizing the solenoid coil SOL1 (5F1 in FIG. 3) of the electromagnetic valve 5F which is connected with the line 5*m*1. By this energization of SOL1, the electromagnetic valve 5F changes the oil passage of the hydraulic line 3*b* over to one direction to feed it to the injection timing regulator 2, so that the relative rotational phase angle between the input shaft 2*a* and the output shaft 2*b* of the fuel injection regulator 2 may be changed to advance the fuel injection timing.

STEP (8):

When the sign of the deviation is determined negative, that is, that the command value Peo is not larger than the feedback value Pe, the central processing circuit 5B sends a signal to the output interface circuit 5D so as to turn on another Darlington transistor, energizing the solenoid coil SOL2 (5F2 in FIG. 3) of the electromagnetic valve 5F which is connected with the line 5*m*2. By this energization of SOL2, the electromagnetic valve 5F changes the oil passage of the hydraulic line 5*b* over to the other direction to feed it to the injection timing regulator 2, so as to retard the fuel injection timing in the opposite way to in the Step (7).

STEP (9):

The fuel injection timing obtained after the energization of the solenoid coil SOL1 and SOL2 of the electromagnetic valve 5F is detected as P'e by this step. P'e is detected in same way as described above for the detection of the fuel injection timing P'e, using FIG. 7.

STEP (10):

A deviation E'r is computed between the command value Peo and the fuel injection timing P'e detected by Step (9) above.

STEP (11):

It is determined whether the absolute value of the deviation E'r computed by Step (10) is larger than the maximum reference deviation Er1. When the absolute value of the deviation E'r is larger than Er1, Steps (9) to (11) are repeated until the absolute value of the deviation E'r is determined not larger than Er1.

STEP (12):

When it is determined that the absolute value of the deviation Er obtained after the energization of the solenoid coil SOL1 or SOL2 of the electromagnetic valve 5F is not larger that the maximum reference deviation Er1, the energization so far conducted for SOL1 or SOL2 is turned off. Then, return to Step (1) to repeat the control.

Summarizing the control of Steps (6) to (12), when the absolute value of the deviation obtained is larger than the maximum reference deviation, the solenoid coil which performs in such direction as to reduce the deviation is continuously energized until the absolute value of the deviation is determined not larger than the maximum reference deviation.

STEP (13):

When the absolute value of the deviation Er is determined not larger than the maximum reference deviation Er1 in Step (5), the application period ts of a driving pulse is computed to drive the solenoid coil SOL1 or SOL2 of the electromagnetic valve 5F.

This application period ts is obtained by adding a period proportional to the absolute value of the deviation Er to the minimum application period tso stored in the memory 5E.

The digital number used in the computer 5 is converted to the equivalent time by being first loaded into a counter and then counted down to zero using an appropriate clock pulse.

In computing the application period ts of a pulse for energizing the solenoid coil SOL1 or SOL2 of the electromagnetic valve 5F, as long as the movement volume of the relative rational phase angle of the injection timing regulator 2 obtained when SOL1 or SOL2 was energized for a given time, is nearly equal in both directions of the operation, the following formula (3) is used for obtaining the application period for either SOL1 or SOL2.

$$ts = tso + \alpha |Er| \quad (3)$$

where $\alpha$ represents a proportional constant for the absolute value of the deviation Er.

However, when the two solenoid coils of the electromagnetic valve 5F have different characteristics or their sensibility is different in one direction from another of the operation of the injection timing regulator 2, change Step (13) in FIG. 4 to ① to ② in FIG. 5.

Now each step in FIG. 5 is described.

STEP (21):

In order to identify the solenoid coil to be energized, examine the sign of the deviation.

STEP (22):

When the sign of the deviation Er is determined positive, that is, that the command value Peo is larger than the feedback value Pe, a computation by the formula (3) is conducted for the solenoid coil SOL1, where tso is the minimum application period for SOL1 and $\alpha$ is the proportional constant for SOL1.

STEP (23):

When the sign of the deviation Er is determined negative, that is, that the command value Peo is not larger than the feedback value Pe, a computation by the following formula (4) is conducted for the solenoid coil SOL2.

$$ts = tso' + \alpha' |Er| \quad (4)$$

where tso' is the minimum application period for the solenoid coil SOL2 and $\alpha'$is the proportional constant for SOL2.

Figure 8:
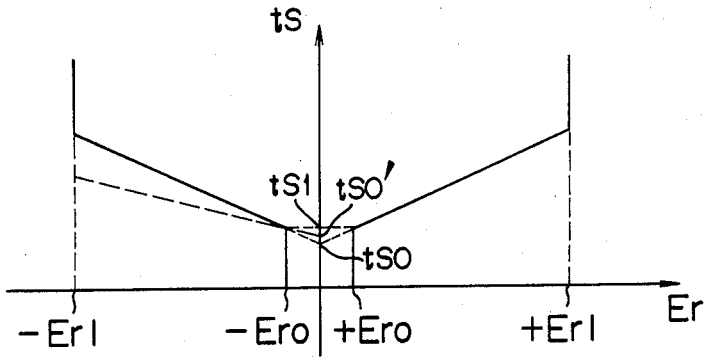
FIG. 8 shows the characteristics of a driving pulse to be applied to the electromagnetic valve shown in FIG. 1, showing the relationship between the pulse application period and the deviation.

The relationship between the deviation Er and the application period ts of the driving pulse to the solenoid coil of the electromagnetic valve 5F so far described above is as shown in FIG. 8.

STEP (14):

After the computation of the pulse application period above, examine the sign of the deviation Er to identify the solenoid coil to be energized.

STEP (15):

When the sign of the deviation Er is determined positive, that is, that the solenoid coil SOL1 is to be energized, the solenoid coil SOL1 is energized for the period ts as computed by Step (13) or (22).

The energization of the solenoid coil SOL1 is conducted as follows: the central processing circuit 5B applies a pulse signal to one Darlington transistor of the output interface circuit 5D for the period ts, so that the solenoid coil SOL1 of the electromagnetic valve 5F which is connected with the line 5 ml may be energized for the period ts.

STEP (16):

When the sign of the deviation Er is determined negative, that is, that the solenoid coil SOL2 is to be energized, the solenoid coil SOL2 is driven for the period ts as computed by Step (13) or (23).

The energization of the solenoid coil SOL2 is conducted as follows: The central pocessing circuit 5B applies a pulse signal to another Darlington transistor of the output interface circuit 5D for the period ts, so that the solenoid coil SOL2 of the electromagnetic valve 5F which is connected with the line 5m2 may be energized for the period ts.

STEP (17):

The fuel injection timing obtained after the energization of the solenoid coil SOL1 or SOL2 of the electromagnetic valve 5F is detected as Pe'. Pe' is detected in same way as described above for the detection of the fuel injection timing Pe, using FIG. 7.

STEP (18):

A deviation E'r is computed between the command value Peo and the fuel injection timing P'e detected by Step (17) above.

STEP (19):

It is determined whether the absolute value of the deviation E'r computed by Step (18) is larger than the minimum reference deviation Ero.

When the absolute value of the deviation E'r is determined not larger than the miniumum reference deviation Ero, it is evaluated that the pulse application period ts computed by Step (13) was appropriate since the absolute value of the deviation Er had come within the minimum reference deviation Ero as the result of the pulse driving by Step (15) or (16), and the control step returns to Step (1) of the control cycle.

STEP (20):

When the absolute value of the deviation E'r is determined larger than the minimum reference deviation Ero in Step (19), it is evaluated that the pulse application period ts at Step (15) or (16) was not appropriate, and the minimum application period tso to be used at Step (13) of the next control cycle is changed.

Since the detail of Step (20) of FIG. 4 is shown in FIG. 6, now referring to FIG. 6, how to change the minimum application period is described.

STEP (24):

Examine the sign of the deviation E'r computed in Step (18).

STEP (25):

When the sign of the deviation E'r is determined positive, further examine the sign of the deviation Er computed by Step (3).

STEP (26):

When the signs of Er and E'r are determined both positive, it is judged that the pulse application resulted in insufficient driving, and an application period having the minimum application period tso plus a predetermined short application period dtso is set as the new minimum application period tso to be used in the next control cycle. When the absolute value of the deviation Er' is larger than the minimum reference deviation and both Er' and Er have the same sign, the actuator is driven in same direction. Therefore, the pulse application conducted at Step (15) or (16) is judged as insufficient.

STEP (27):

When the sign of Er' is determined positive but that of Er is determined negative, it is judged that the pulse application resulted in excessive driving, and an application period having the minimum application period tso deducted by the short application period dtso is set as the new minimum application period tso to be used in the next control cycle. When the absolute value of the deviation Er is larger than the minimum reference deviation and Er has the different sign from that of Er, the actuator is driven in the opposite direction. Therefore, the pulse application conducted at Step (15) or (16) is judged as excessive or overshooting.

STEP (28):

When the sign of the deviation Er' is determined negative, further examine the sign of the deviation Er computed by Step (3). When the sign of the deviation Er is determined negative, it is judged that both Er' and Er have the same polarity. Therefore, the next step shall be Step (26). When the sign of the deviation Er is determined positive at this step, it is judged that Er' has the different sign from that of Er and therefore the next step shall be Step (27).

When the processing by Step (20) is completed, the control step returns to Step (1) to conduct the next control cycle.

The method of controlling an actuator according to the present invention as described above in the preferred embodiment by referring to FIGS. 4, 5 and 6 has the following advantages:

(1) In the above embodiment, if the minimum reference deviation is taken as the dead zone in the bang-bang control, we can say like this. In the range that the deviation Er is larger than the minimum reference deviation Ero but smaller than the maximum reference deviation Er1, the actuator is driven by a pulse having the application period of the sum of a minimum application period tso enabling the actuator to start operation and an application period proportional to the absolute value of the deviation Er. Therefore, if a minimum application period tso appropriate for the actuator and an appropriate proportional constant x are used, even if the dead zone is made narrower to improve the controlling accuracy, the system can achieve a stable control without causing the so-called limit cycle oscillation.

(2) When the absolute value of the deviation Er is larger than the maximum reference deviation Er1, the actuator is continuously driven until the absolute value of the deviation becomes smaller than the maximum reference deviation in the direction to minimize the absolute value of the deviation. Therefore, for a sudden change of the command value, a delay caused by the pulse application is lessened.

(3) Different values can be used for the minimum application period deviation depending on the driving direction of the actuator. Therefore, even if the sensitivity of the actuator driving is different in one direction from another, appropriate controlling in possible.

(4) When the absolute value of the deviation Er' obtained after the pulse application to the actuator does not enter within the dead zone, the minimum application period tso or tso' is changed, depending on the determination of whether the pulse application resulted in insufficient or excessive driving, to improve the controlling accuracy at each control cycle. Therefore, even if the initial appplication period determined for an actuator is away from the optimum value, the controlling accuracy is improved by repeating control cycles.

Therefore, the minimum aplication period is changed to be more accurate in response to such surrounding conditions as difference in characteristics of each product, change in oil temperature due to the operation of the hydralic system, fluctuation of power source voltage, etc. not only at the initial condition but also during the course of the control, to be extremely suitable to make the system precise.

(5) As described in the preferred embodiment above, when the control system according to the present invention is applied to a control system for fuel injection timing for an diesel engine, the control is so made with the optimum injection timing predetermined by experiments that the diesel engine may always be operated at the optimum condition for any engine speed, displacement of accelerator pedal and water and air temperature.

What is claimed is:

1. A method for controlling an actuator by using a digital controller, comprising the steps of:

(a) obtaining a command value and a feed-back value;

(b) determining a deviation between said command value and said feedback value;

(c) comparing the absolute value of said deviation with a predetermined minimum reference deviation;

(d) determining whether said absolute value of said deviation is larger than said predetermined minimum reference deviation or not;

(e) judging the sign of said deviation when said absolute value of said deviation is larger than said predetermined minimum reference deviation;

(f) driving said actuator in a direction determined by the sign and by utilizing a driving pulse having a pulse width consisting of a period in proportion to said absolute value of said deviation and a minimum application period previously stored in a memory, when said absolute value of said deviation is larger than said predetermined minimum reference deviation.

2. The method for controlling an actuator according to claim 1, wherein said actuator comprises a solenoid valve and an object to be hydraulically operated by said solenoid valve, and said driving pulse is applied to a solenoid coil of said solenoid valve.

3. The method for controlling an actuator according to claim 2, wherein said object to be hydraulically operated by said solenoid valve is an injection timing regulator.

4. The method for controlling an actuator according to claim 1, further comprising the steps of (f) changing said minimum application period to a new minimum application period having said minimum application period and a predetermined short application period in order to determine a minimum application period to be used in a next control cycle when the driving of said actuator is in insufficient; and (g) deducting a predetermined short application period from said minimum application period from said minimum application period in order to determine a minimum application period to be used in a next control cycle when the driving of said actuator is in excessive.

5. The method for controlling an actuator according to claim 4, wherein said driving of said actuator being insufficient is judged when an absolute value of a next determined deviation between said command value and a next feedback value is larger than said minimum reference deviation and when the sign of said next determined deviation is equal to the sign of the deviation proceeding to said next determined deviation, and said driving of said actuator being excessive is judged when the sign of said next determined deviation is different from the sign of the deviation proceeding to said next determined deviation.

6. The method for controlling an actuator according to claims 4 or 5, wherein said actuator comprises a solenoid valve and an object to be hydraulically operated by said solenoid valve, and said driving pulse is applied to a solenoid coil of said solenoid valve.

7. The method for controlling an actuator according to claim 6, wherein said object to be hydraulically operated by said solenoid valve is an injection timing regulator.

8. A method for controlling an actuator by using a digital controller, comprising the steps of:

(a) obtaining a command value and a feedback value;

(b) determining a deviation between said command value and said feedback value;

(c) comparing the absolute value of said deviation with a predetermined minimum reference deviation;

(d) determining whether said absolute value of said deviation is larger than said predetermined minimum reference deviation or not;

(e) comparing said absolute value of said deviation with a predetermined maximum reference deviation when said absolute value of said deviation is larger than said predetermined minimum reference deviation;

(f) judging the sign of said deviation when said absolute value of said deviation is larger than said predetermined minimum reference deviation;

(g) driving said actuator in a direction determined by the sign and by utilizing a driving pulse having a pulse width consisting of a period in proportion to said absolute value of said deviation and a minimum application period previously stored in a memory when said absolute value of said deviation is larger than said predetermined minimum reference deviation and smaller than said predetermined maximum reference deviation; and (h) continuously driving said actuator until an absolute value of a next determined deviation between said command value and a next feed value becomes smaller than said predetermined maximum reference deviation.

9. The method for controlling an actuator according to claim 8, wherein said actuator comprises a solenoid valve and an object to be hydraulically operated by said solenoid valve, and said driving pulse is applied to a solenoid coil of said solenoid valve.

10. The method for controlling an actuator according to claim 9, wherein said object to be hydraulically operated by said solenoid valve is an injection timing regulator.

11. A method for controlling an actuator by using a digital controller, comprising the steps of:

(a) obtaining a command value and a feedback value;

(b) determining a deviation between said command value and said feedback value;

(c) comparing the absolute value of said deviation with a predetermined minimum reference deviation;

(d) determining whether said absolute value of said deviation is larger than said predetermined minimum reference deviation or not;

(e) judging the sign of said deviation when said absolute value of said deviation is larger than said predetermined minimum reference deviation;

(f) driving said actuator by utilizing a driving pulse having a pulse width consisting of period in proportion to said absolute value of said deviation with a first proportional constant and a first minimum application period previously stored in a memory when said sign of said deviation is positive; and (g) driving said actuator by utilizing a driving pulse having a pulse width consisting of period in proportion to said absolute value of said deviation with a second proportional constant and a second minimum application period previously stored in the memory when said sign of said deviation is negative.

12. The method for controlling an actuator according to claim 11, wherein said actuator comprises a solenoid valve and an object to be hydraulically operated by said solenoid valve, and said driving pulse is applied to a solenoid coil of said solenoid valve.

13. The method for controlling an actuator according to claim 12, wherein said object to be hydraulically operated by said solenoid valve is an injection timing regulator.

* * * * *